United States Patent [19]

Racek

[11] 4,352,658

[45] Oct. 5, 1982

[54] GAS LIGHTER

[76] Inventor: Alfred Racek, Seitenbergstr. 54, 1160 Vienna, Austria

[21] Appl. No.: 126,358

[22] Filed: Mar. 3, 1980

[30] Foreign Application Priority Data

Mar. 5, 1979 [AT] Austria ..... 1628/79

[51] Int. Cl.[3] ..... F23Q 1/04

[52] U.S. Cl. ..... 431/254; 431/125; 431/131; 431/277

[58] Field of Search ..... 431/254, 255, 131, 277, 431/125, 350, 151

[56] References Cited

U.S. PATENT DOCUMENTS 3,521,985 7/1970 Chrisman et al. ..... 431/151

3,748,086 7/1973 Retzler ..... 431/171

*Primary Examiner*—Edward G. Favors

*Attorney, Agent, or Firm*—Karl F. Ross

[57] ABSTRACT

A gas lighter has a pistol-shaped casing that contains a gas cartridge in line with a mouthpiece which simulates a muzzle and forms a hood overhanging a striker wheel coacting with a spring-pressed flint. The striker wheel is clamped between cheeks of a reel which is eccentrically linked with a slider having an actuator in the shape of a trigger and trigger guard, the latter being articulated to a toggle joint urged by a transverse spring into a nearly straight-line position whereby a squeezing of the trigger results in an accelerating rotation of the wheel against the flint. The slider also opens a shut-off valve at the cartridge to allow the outflow of gas which is ignited by sparks from the flint hurled toward the hood.

4 Claims, 3 Drawing Figures

GAS LIGHTER

FIELD OF THE INVENTION

My present invention relates to a cigarette lighter or the like of the type wherein a pyrophoric device is used to ignite a flow of flammable gas by a suitable source, usually a cartridge, inside a casing having a mouthpiece aperture in line with that source.

BACKGROUND OF THE INVENTION

Pyrophoric devices used in such a lighter generally comprise an abrasive striker wheel coacting with a flint which is pressed against the striker-wheel surface by a spring. The striker wheel, lying in a plane which includes the axis of the mouthpiece aperture and of the gas cartridge in line therewith, generates sparks designed to enter the gas flow issuing from the cartridge. It has already been proposed to use a sleeve situated near the periphery of the striker wheel or tongues carried by a flint-holding tube for the guidance of the sparks. With or without such guidance means, the sparks move generally transversely to the gas flow and, to a significant extent, pass through that flow at such a high speed that contact time is insufficient for ignition. Under adverse conditions, e.g. with low ambient temperatures or high humidity, such a lighter may fail to fire.

OBJECT OF THE INVENTION

The object of my present invention, therefore, is to provide a lighter of the type referred to with means for insuring sufficient contact between the gas flow and the generated sparks to assure ignition under practically all circumstances.

SUMMARY OF THE INVENTION

I realize this object, in accordance with my present invention, by providing a hood on the mouthpiece of the lighter casing, this hood extending inward from the mouthpiece aperture toward the gas cartridge and bounding an intervening ignition space on the side of the cartridge axis opposite the pyrophoric device for intercepting sparks traversing the gas flow and redirecting same into the ignition space.

Pursuant to another feature of my invention, the mouthpiece advantageously forms also a frustoconical external shroud which surrounds its aperture and broadens in the direction of gas flow to shield the exiting sparks at or near the point of ignition.

BRIEF DESCRIPTION OF THE DRAWING

The above and other features of my present invention will now be described in detail with reference to the accompanying drawing in which.

SPECIFIC DESCRIPTION

Figure 1:
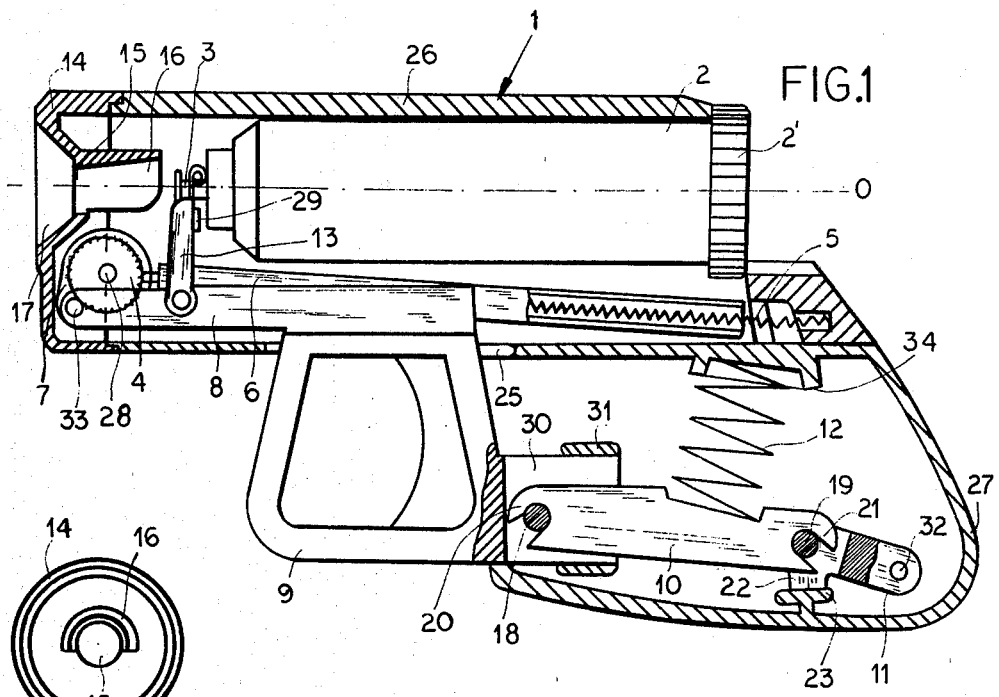
FIG. 1 is a longitudinal sectional view of my improved gas lighter in a quiescent position.
Figure 3:
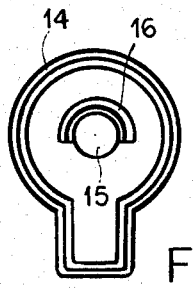
FIG. 3 is a face view of a mouthpiece forming part of the lighter.

The lighter shown in the drawing comprises a casing 1 with a barrel-shaped upper part 26 and a flat lower part 27 simulating a pistol grip. The barrel 26 is closed at the front by a tightly fitting but preferably detachable mouthpiece 14 and at the back by the bottom 2' of an inserted gas cartridge 2. Mouthpiece 14, simulating a muzzle, has an aperture 15 which is centered on the axis 0 of cartridge 2 and is aligned with a shut-off valve 3 normally blocking an outlet at the front end of the cartridge. An intervening ignition space is bounded at the top by a hood 16 rigid with the mouthpiece, this hood having a generally semi-cylindrical outer surface and a tapering inner surface narrowing toward aperture 15 which approaching the axis 0. Mouthpiece 14 further forms an external shroud 17 of frustoconical shape broadening outwardly, i.e. in the direction of a gas flow issuing from cartridge 2 and passing through aperture 15 when the valve 3 is opened.

On the side of axis 0 opposite hood 16, i.e. below the ignition space separating the cartridge outlet from aperture 15, there is provided a pyrophoric device comprising an abrasive striker wheel 4 against which a flint 24 guided in a stationary tube 6 is pressed by a coil spring 5. Striker wheel 4, lying in a plane which includes the cartridge axis 0, is clamped between cheeks of a reel 7 which has a hub traversing the reel and is rotatably mounted on a pin 28. Reel 7 is eccentrically joined by a pin 33 to a slider 8 rigid with an actuator 9 which passes through a slot 25 on the underside of barrel 26 and is shaped like a trigger and guard of a pistol. A lever 13 pivoted to slider 8 engages the valve 3 of cartridge 2 and carries a tab 29 which comes to rest against the rim of the front end of the cartridge when the actuator 9 is moved to the right as shown in FIG. 2, thereby swinging counterclockwise to open the valve 3. A bifurcate extension 30 of the actuator 9, guided between fixed lugs 31 in pistol grip 27, carries a pin 18 which is received in a slot of an extremity 20 of a lever 10 embraced by the bifurcation 30; the opposite extremity 21 of lever 10 is bracketed by prongs of a bifurcate extremity of a shorter lever 11 and has a slot receiving a pivot pin 19 on the latter lever. The end of lever 11 remote from pin 19 has a fixed fulcrum in the form of a pin 32 secured to casing 1, this pin being almost in line with the path of motion of pin 18 upon the displacement of slider 8 between the positions shown in FIGS. 1 and 2. It will be understood that actuator 9 is guided with sufficient play to let the pin 33 swing through an arc between the two limiting positions shown in these Figures.

Figure 2:
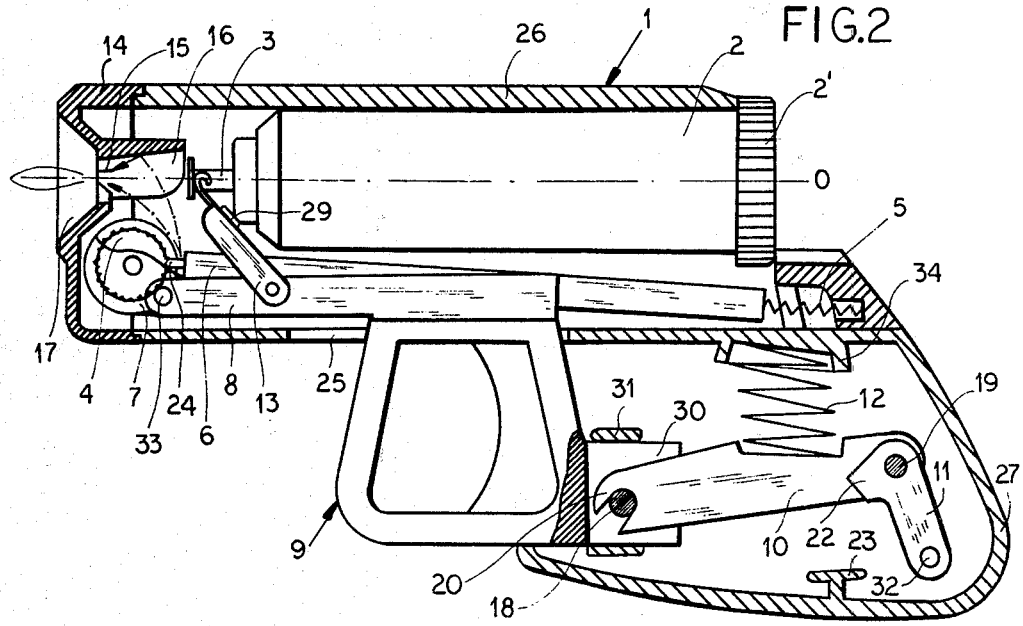
FIG. 2 is a view similar to FIG. 1 but showing the lighter in an operated position.

A coil spring 12, received in a lodgment 34 of casing 1, bears under moderate pressure upon lever 10 in the vicinity of pivot 19 to urge the toggle joint constituted by levers 10 and 11 into a nearly straight-line position, as shown in FIG. 1 in which an extension 22 of lever 11 comes to rest on an internal abutment 23 within pistol grip 27. A user inserting a finger into the trigger guard of actuator 9 must therefore exert considerable initial pressure to dislodge the toggle joint from the position of FIG. 1, yet the resistance encountered drops off rapidly as the joint approaches the angular position of FIG. 2. The exerted force thus becomes available for a rapid counterclockwise acceleration of striker wheel 4 which generates sparks flying toward the ignition space now traversed by a flow of gas issuing from cartridge 2 through the opened valve 3. Though a considerable number of these sparks may traverse the gas too quickly to be able to ignite same, they are promptly redirected by the overhanging hood 16 toward the axis 0 in order to do their work on being swept out by the gas flow through aperture 15. Shroud 17 protects the exiting sparks from outside drafts, thereby further facilitating ignition, and also shields the resulting flame. Upon the release of actuator 9, spring 12 returns the mechanism to the quiescent position of FIG. 1 with closure of valve 3.

The slotted extremities of lever 10 engaging pins 18 and 19 simplify the assembly of the toggle joint. Since the slots point away from spring 12, the pressure exerted by that spring prevents any disengagement.

The external shape of the pistol-shaped lighter has been illustrated in my concurrently filed application Ser. No. 126,360 of even date, whose disclosure is hereby incorporated by reference into the present application, and is also the subject matter of my design application Ser. No. 118,776 filed Feb. 5, 1980.

I claim:

1. A gas lighter comprising:

a casing provided with a mouthpiece having an aperture;

a gas cartridge in said casing having an axis aligned with said aperture and an outlet on said axis separated by an ignition space from said mouthpiece, said cartridge being provided with a shut-off valve normally closing said outlet;

pyrophoric means in said casing at a location offset from said axis for igniting a flow of flammable gas issuing from said outlet, said pyrophoric means including a spark-generating wheel in a plane including said axis;

actuating means coupled with said wheel and with said shut-off valve for opening the latter while rotating said wheel in a direction aiming the generated sparks toward said ignition space; and a hood on said mouthpiece extending inward from said aperture toward said cartridge and bounding said ignition space on a side of said axis opposite said pyrophoric means for intercepting sparks traversing the gas flow and redirecting such sparks into said ignition space, said hood having a concave side open toward said spark-generating wheel.

2. A gas lighter as defined in claim 1 wherein said mouthpiece forms a frustoconical external shroud surrounding said aperture and broadening in the direction of gas flow.

3. A gas lighter as defined in claim 1 or 2 wherein said hood has a generally semicylindrical outer surface and a tapering inner surface narrowing toward said aperture approaching said axis.

4. A gas lighter as defined in claim 1 or 2 wherein said mouthpiece is detachable from said casing.

* * * * *